US005694855A

United States Patent [19]

Gardner

[11] Patent Number: 5,694,855

[45] Date of Patent: Dec. 9, 1997

[54] STATIONERY STAMPING SYSTEM

[76] Inventor: Martin L. Gardner, 8665 Boca Glades Blvd. W, Boca Raton, Fla. 33434

[21] Appl. No.: 664,746

[22] Filed: Jun. 17, 1996

[51] Int. Cl.[6] ..... B41F 1/28; B41F 1/34

[52] U.S. Cl. ..... 101/474; 101/407.1; 101/481; 101/486; 33/562

[58] Field of Search ..... 101/327, 333, 101/334, 481, 486, 485, 407.1, 474; 33/562, 563

[56] References Cited

U.S. PATENT DOCUMENTS

| | | | |
|---|---|---|---|
| 4,537,128 | 8/1985 | Burroughs et al. | 101/474 |
| 4,579,057 | 4/1986 | Hewitt | 101/368 |
| 4,742,771 | 5/1988 | Heilig | 101/327 |
| 5,031,332 | 7/1991 | Newman | 33/562 |
| 5,228,387 | 7/1993 | Sicucan | 101/211 |

*Primary Examiner*—Edgar S. Burr
*Assistant Examiner*—Leslie Grohusky
*Attorney, Agent, or Firm*—Alvin S. Blum

[57] ABSTRACT

A system for imprinting stationery including envelopes, letters and cards with return addresses, sending addresses, letterheads and other indicia uses inexpensive self inking stamps. A horizontal rectangular top plate is provided with apertures through which the stamps pass when imprinting on a piece of stationery. The top plate is supported above a flat horizontal support surface on which the piece of stationery rests by a three sided fence which provides positioning stops for the stationery. The apertures are located at predetermined positions on the top plate so as to correctly position imprinting of sending addresses, return addresses and letterheads on stationery of various sizes. The positioning and registry is so well maintained that different colored stamps may be used in the same aperture to produce multicolor printing. By providing a system that produces high quality custom printed stationery as needed, the volume storage and expenses of preprinted stationery is avoided. When a change is required, a new stamp can be procured at minimal cost.

2 Claims, 1 Drawing Sheet

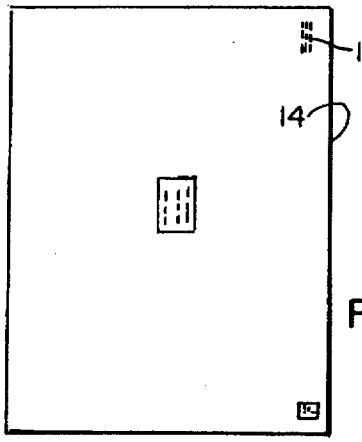
FIG. 8
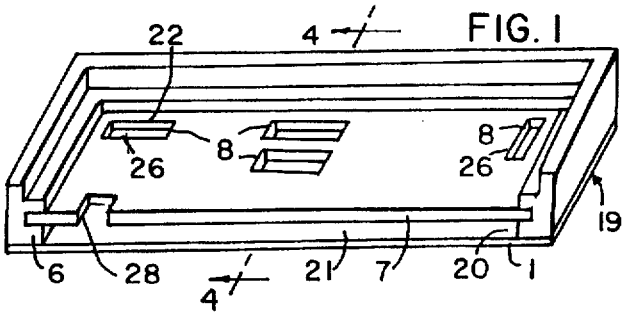
FIG. 1
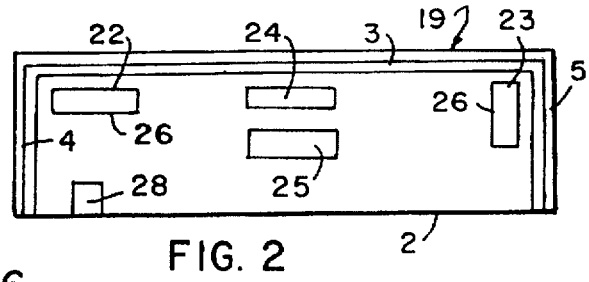
FIG. 2
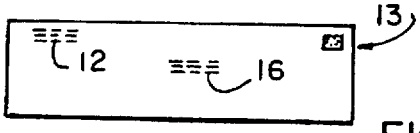
FIG. 6
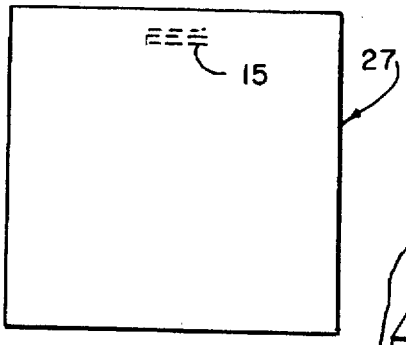
FIG. 7
FIG. 5
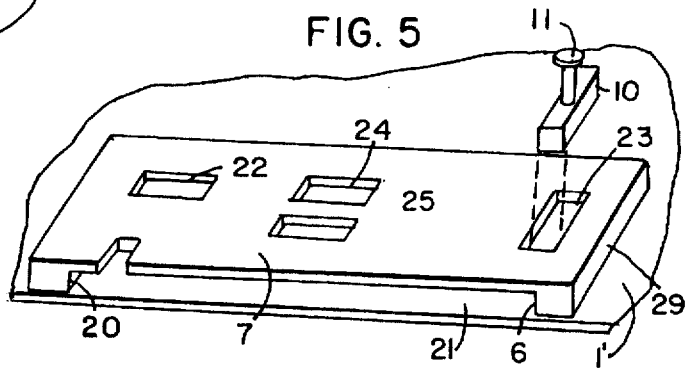
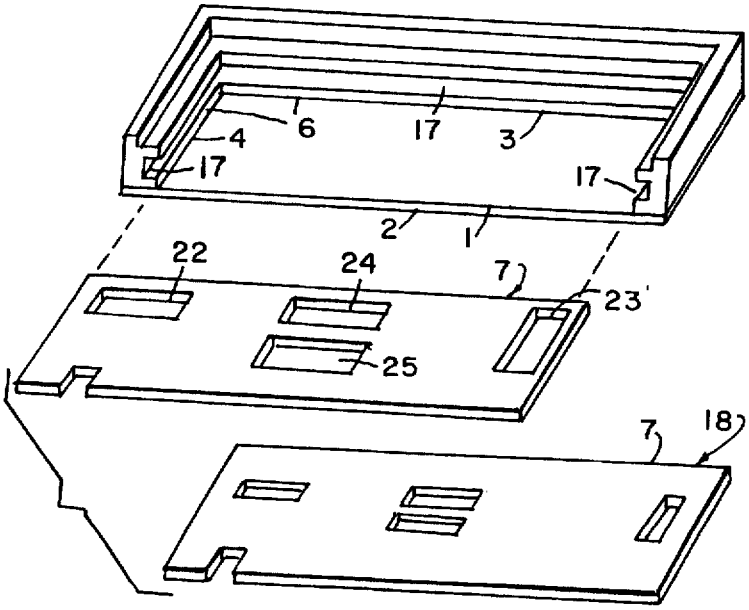
FIG. 3
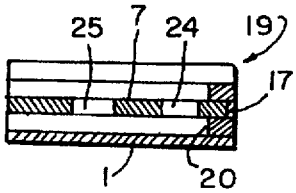
FIG. 4

STATIONERY STAMPING SYSTEM

This invention relates to positioning devices and more particularly to a stamp positioning device for imprinting paper sheets and envelopes.

Business people have their envelopes and letter paper imprinted with their return address, letterhead, logos and the like. Printers charges are based on volume. Consequently, the business will generally order envelopes of several sizes and letterheads in large quantities. When there is reason to change the printed information, such as change in firm name, address, or telephone number, the unused stationery must be discarded and new material printed. This can be quite an expense to a small firm. The costs may be avoided by using a custom stamp with the information. A further advantage of using a stamp for a business with multiple firm names is that storage space is reduced, since one batch of stationery can be stored for all the different names, and only enough stationery for immediate needs need be bought and stored.

Self-inking rubber stamps are of considerable help in stamping stationery, since they can be carefully positioned directly on the paper without staining the paper. Forcing the plunger down then lowers the inked rubber portion down onto the paper. The process does require some skill and time in accurately positioning the stamp before pressing the plunger. The user must either accept poorly imprinted stationery that looks quite unprofessional or discard those items.

SUMMARY OF THE INVENTION

It is accordingly an object of the invention to provide a system for stamping stationery with an inked stamp that ensures accurate positioning of the printed matter on a variety of different types and sizes of stationery and that requires very little skill and time.

The system of the invention comprises a base that is dimensioned to hold a variety of envelopes of different sizes as well as sheets of paper. A template attached to the base is provided with a plurality of apertures. Each aperture is dimensioned to receive the outer housing of a self inking rubber stamp. The apertures are arranged on the template so as to enable a stamp to print on the stationery held in the base at the various locations that are ordinarily used in printing stationery. This may include return address on the upper left corner of large and small envelopes, letterheads in the top center and self address in the middle center. The aperture holds the stamp outer housing in the correct position while the plunger is depressed to print on the stationery held in the base. Because of the reproducibility of the registry, multicolor printing is also provided for by simply stamping with different color inks in the same aperture without moving the paper between stamp changes.

These and other objects, advantages and features of the invention will become more apparent when the detailed description is considered in conjunction with the drawings, in which like reference characters refer to like elements in the various drawing figures.

BRIEF DESCRIPTION OF THE DRAWINGS

FIG. 1 is a perspective view of the invention.

FIG. 2 is a top view of the invention.

FIG. 3 is a perspective view of the invention disassembled.

FIG. 4 is a sectional view taken through line 4—4 of FIG. 1.

FIG. 5 is a perspective view of another embodiment of the invention.

FIG. 6 is a plan view of a business size envelope stamped with the invention.

FIG. 7 is a plan view of a letterhead imprinted using the invention.

FIG. 8 is a plan view of a large envelope imprinted using the invention.

DETAILED DESCRIPTION OF PREFERRED EMBODIMENTS

Referring now first to FIGS. 1–4, the system 19 of the invention has a rectangular base plate 1 with a smooth flat horizontal upper surface and long front edge 2 and back edge 3 and short left side edge 4 and right side edge 5. A perimetral fence 6 is upstanding vertically from the back and side edges. A top plate holding groove 17 on the inner vertical face 20 of the fence 6 is adapted to removably hold therein a top plate 7 spaced apart from, and parallel to, the base plate.

This arrangement provides a space 21 bounded by the top plate, the base plate, and the perimetral fence for holding therein at least part of a piece of stationery for imprinting with one or more self inking stamps 10. The space 21 has an open front end through which the piece of stationery may be inserted wholely or in part. The top plate is spaced above the base plate a distance of about ⅛ of an inch for easily inserting an empty envelope or sheet of paper therein. The fence 6 provides stops for reproducible positioning of the stationery.

The top plate is provided with a plurality of apertures 8 adapted for receiving therethrough a self inking stamp 10 of the rubber stamp type that is custom prepared with type and graphics for imprinting on paper. After the stamp is inserted into the aperture and rested upon the paper, the plunger handle 11 of the stamp is depressed to print on the paper.

By reproducibly and precisely positioning the stamp relative to the stationery, the quality of the resulting printing can equal that of commercially printed stationery.

A first aperture 22 has a long dimension 26 parallel to the back edge. It is located adjacent the left side edge and the back edge for imprinting return address 12 on a business size envelope 13 such as a 9"×4" size as illustrated in FIG. 6.

A second aperture 23 is located adjacent the back edge and right side edge for imprinting a return address 12 on a large envelope 14 such as a 9"×12" size as illustrated in FIG. 8. This size envelope does not fit completely into the space 21, but the portion that does fit in the space is held securely enough with the upper left corner positioned beneath the second aperture 23 to provide for effective imprinting.

A third aperture 24 is positioned adjacent the back edge and midway between the side edges for stamping a letterhead imprint 15 on a sheet of paper 27 as illustrated in FIG. 7.

A fourth aperture 25 is located substantially midway between the side edges and the front and back edges. It is useful for printing a sending address 16 on an envelope or card as illustrated in FIG. 6. The positions of the apertures and their dimensions may be varied to suit particular purposes. A convenient means of accomplishing this purpose is to provide at least one additional top plate 18 having the different size and/or positioned apertures as desired.

For convenience in manipulating smaller pieces of stationery, a notch 28 deleting a less than total portion of the front margin may be provided in the front margin of the top plate.

Referring now to the alternative embodiment of the invention illustrated in FIG. 5, the top plate 7 is permanently attached to the fence 6 which extends downward therefrom along the two side edges and the back edge. There is no attached base plate, the fence 6 resting instead on any smooth flat horizontal support surface on which the stationery will rest during the stamping process. The support surface 1' serves as the base plate 1. This may be a desk or table top for example. The space 21 is defined by the support surface 1', the top plate 7 and the back and side portions of fence 6 which support the top plate about one eighth of an inch above the support surface 1', leaving a space at the front edge for insertion of the stationery in whole or in part.

A high friction material 29 may be provided on the underside of the invention to restrain sliding of the system when in use.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A system for imprinting a piece of stationery having opposed sides with self inking stamps, the system comprising:

a horizontal rectangular base plate having long front and back edges, short left and right side edges, and fixed dimensions;

a perimetral fence upstanding vertically from the side edges and the back edge, said perimetral fence having side edges and a back edge;

a removably mounted horizontal rectangular solitary top plate having fixed dimensions held in place spaced above and apart from the base plate by the perimetral fence side and back edges;

the base plate, top plate, and perimetral fence defining a space for holding therein at least a portion of a piece of stationery insertable over the front edge so that the opposed sides of the piece of stationery are contained within the side edges of the fence;

a plurality of fixed apertures in the solitary top plate, each aperture adapted for removably receiving therethrough a self inking stamp, said plurality of apertures including;

a first aperture located adjacent the left and back edges and having a long dimension parallel to the back edge for imprinting a return address on a business size envelope;

a second aperture located adjacent the right and back edges and having a long dimension parallel to the right edge for imprinting a return address on a large size envelope; and a third aperture located adjacent the back edge and midway between the side edges having a long dimension parallel to the back edge for imprinting a letterhead; and at least one additional top plate having a different arrangement of apertures, said additional top plate being substitutable for said removably mounted top plate to enable printing on different areas of the stationery.

2. The system according to claim 1 further comprising a notch deleting a less than total portion of the front edge of the top plate for providing access to the stationery for facilitating manipulation of small pieces of stationery.

* * * * *